United States Patent [19]

Hanstine et al.

[11] Patent Number: 4,620,674

[45] Date of Patent: Nov. 4, 1986

[54] PNEUMATIC ACTUATED ROLLER ASSEMBLY FOR A ROLLER MILL

[75] Inventors: Kenneth W. Hanstine, Walnutport; Stephen A. Lukacz, Nazareth; Jeffrey N. Nelson, Bethlehem, all of Pa.

[73] Assignee: Fuller Company, Bethlehem, Pa.

[21] Appl. No.: 631,355

[22] Filed: Jul. 16, 1984

[51] Int. Cl.[4] ..... B02C 15/00

[52] U.S. Cl. ..... 241/121; 241/289

[58] Field of Search ..... 241/37, 101.2, 132, 241/133, 121, 122, 128, 287, 288, 289, 290, 175

[56] References Cited

U.S. PATENT DOCUMENTS

| | | | |
|---|---|---|---|
| 2,833,483 | 5/1958 | China | 241/37 |
| 4,164,328 | 8/1979 | Kausel et al. | 241/175 |
| 4,339,086 | 7/1982 | Brundiek | 241/121 |

FOREIGN PATENT DOCUMENTS

| | | | |
|---|---|---|---|
| 2062494 | 5/1981 | United Kingdom | 241/37 |

OTHER PUBLICATIONS

"Airstroke Actuators, Airmount Isolators" Firestone Industrial Products Company.

Goodyear Tire and Rubber Company Publication, 1979.

Disc Roll Mill, Mining Engineering, 5-1961, p. 513.

*Primary Examiner*—Mark Rosenbaum

*Attorney, Agent, or Firm*—Frank H. Thomson

[57] ABSTRACT

A pneumatic system for exerting a downward grinding force on the roller assemblies of a roller type grinding mill. The pneumatic system consists of a plurality of resilient and flexible pneumatic cylinders or bellows operatively connected through a crank arm, a horizontal rotatable shaft and lever to the roller assembly. The flexible pneumatic cylinders exert an upward force on the crank arm which in turn exerts a downward force through the rotatable shaft and lever on the grinding roll. Vertical movement and vibration of the roller assembly is absorbed by the flexible cylinder to maintain a steady grinding force on the rollers.

4 Claims, 4 Drawing Figures

PNEUMATIC ACTUATED ROLLER ASSEMBLY FOR A ROLLER MILL

BACKGROUND OF INVENTION

This invention relates to roller mills of the type utilizing a rotating grinding table and one or more grinding rollers adapted to rotate about their own axis and cooperate with the rotating grinding table to grind solid bulk materials such as coal or cement raw meal. More particularly, the present invention relates to an improved apparatus for exerting a downward grinding force on the roller assembly.

Prior to the present invention, roller mills of the type to which the present invention relates are well known. These mills include a grinding table mounted within a closed housing. The grinding table is rotated about a vertical axis by any suitable means such as an electric motor through a gear box. The other grinding element for mills of this type includes a roller assembly mounted within the housing for rotation about its own axis at an angle to the vertical for cooperation with the rotating grinding table to comminute solid material between the rotating grinding table and the roller.

Ground material spills over the edge of the grinding table where it may be picked up by a gas stream flowing upwardly through the housing to a gas solid separator or air classifier which may be located on top of the mill. The classifier rejects oversize particles and returns them for regrinding. Product having a desired fineness will travel out of the classifier to a dust collector entrained in the gas stream with product being separated in the dust collector. It is common practice to utilize the gas for entraining products out of the mill for drying the material.

In order to accomplish grinding on the table, it is necessary to exert a downward grinding force on the roller assembly so that a grinding force is applied to the material between the grinding table and the roller assembly.

Prior to the present invention, it is typical to utilize hydraulic systems to exert a grinding force on the roller assembly. Other systems utilize a combination hydraulic and pneumatic cylinder or mechanical springs to exert the grinding force.

Hydraulic systems and hydrualic pneumatic systems have the disadvantage that the installations can be complex and expensive. Proper pumping, piping and filtration equipment is required in order to maintain the hydraulic system. This is particularly true where equipment is operating in a dusty atmosphere such as is associated with material grinding mills for a cement plant or coal grinding station. In addition, hydraulic systems must be operated at high pressure on the order of 1,000 p.s.i. requiring heavy duty equipment.

A further disadvantage with prior systems is that the hydraulic systems operated through linkages so that all forces are in a downward direction.

A further disadvantage of prior systems for exerting a downward grinding force on roller systems is that they require the use of fabricated steel housings and support systems. This is believed to unnecessarily add to the cost of the roller mill.

SUMMARY

It is the principal object of this invention to provide an arrangement for supporting and exerting a downward force on a grinding roller of a roller mill apparatus.

It is a further object of this invention to provide a pneumatic system for exerting a grinding force on the grinding roller of a roller mill.

The foregoing and other objects will be carried out by providing in a grinding mill including a housing, a grinding table mounted within said housing for rotation about a substantially vertical axis, at least one grinding roller mounted for rotation about its own axis which is at an angle to the axis of the table and cooperable with said table for grinding material between said table and said roller, an improved means for supporting said grinding roller comprising a pressurized, flexible cylinder means operatively connected to the grinding roller for producing a downward grinding force on said grinding roller.

With the present invention, a plurality of flexible pneumatic cylinder means includes elastomeric bellows such as those sold by The Firestone Tire and Rubber Company under the trademark "Airstroke". These flexible pneumatic cylinders are supported on a suitable foundation and are connected to a crank arm. The crank arm in turn is connected to a shaft mounted for rotation about its own horizontal axis with the shaft having fixed thereto a lever which supports the grinding roll assembly. The pneumatic cylinder exerts an upward force on the crank arm which in turn exerts a downward grinding force on the grinding roll assembly. The downwardly forced grinding roller cooperates with the rotating grinding table to reduce the size of particulate material between the grinding table and the roller assembly.

BRIEF DESCRIPTION OF THE DRAWINGS

The invention will be described in connection with the annexed drawings wherein.

DESCRIPTION OF THE PREFERRED EMBODIMENT

Figure 1:
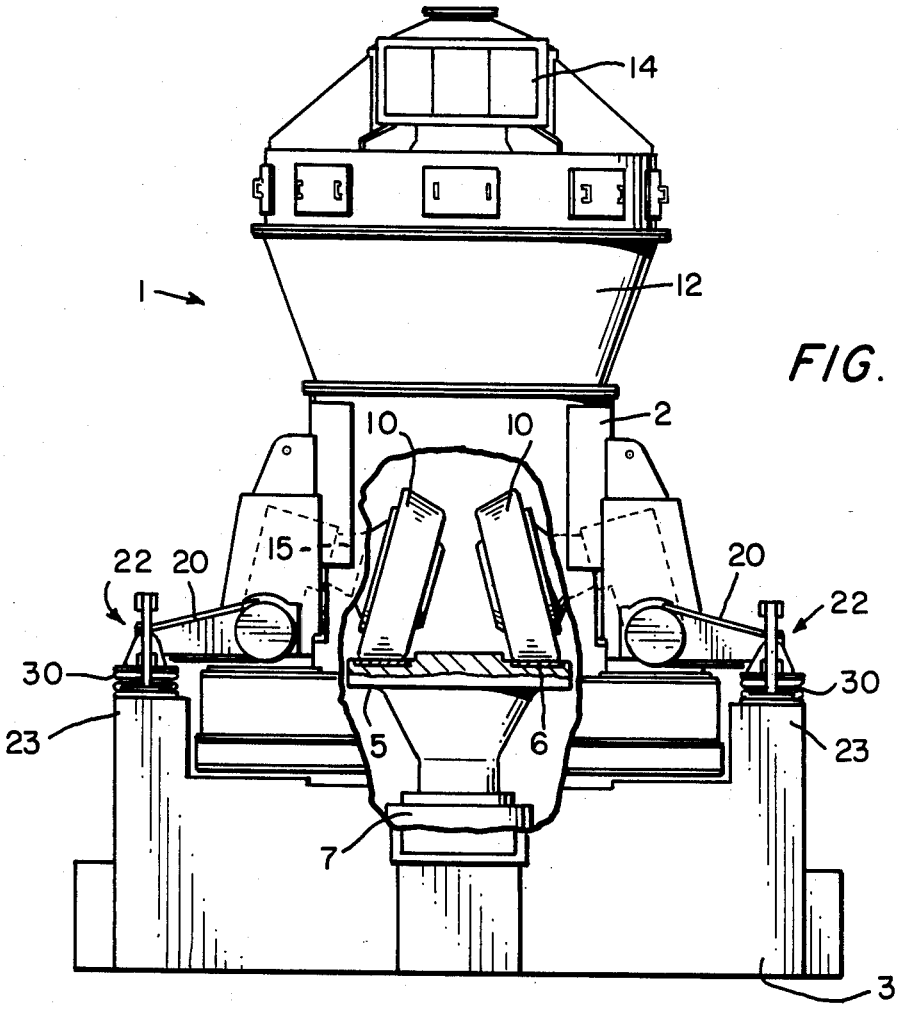
FIG. 1 is a view of a roller mill utilizing the present invention with parts broken away to show the internals of the mill.

Referring to FIG. 1, the invention relates to a roller mill generally indicated by the numeral 1 which mill includes a mill housing generally indicated at 2 which is supported on a suitable concrete foundation 3. Within the mill housing, a first grinding element or grinding table 5 is mounted for rotation about a vertical axis and may include a wear surface 6. The table 5 is operatively connected to a gear box 7 and a suitable drive motor (not shown). The other grinding element of a roller mill includes one or more grinding rollers or roller assemblies 10 each of which is mounted for rotation about its own axis which is at an angle to the axis of the table 5. In the present invention two such grinding rollers are utilized but in other mills there may be three or four such assemblies. As the table 5 is rotated, material between the table and the roller 10 acts as a clutch so that the roller 10 is rotated about it own axis.

In accordance with usual roller mill practice, material to be ground is supplied to the rotating table 5. As the table rotates, material is ground between table 5 and rollers 10. Ground materials overflow off the table and is entrained in air flowing upwardly through the mill towards classifier 12. Coarse material is returned from classifier 12 to the table 5. Fines entrained in the air are separated in the dust collector as product of the mill. The upper part of the mill includes a classifier generally indicated at 12. The top of the mill includes an outlet 14 for gas and entrained material which is suitably connected to a dust collection system (not shown).

The present invention provides an improved means for supporting the grinding roller 10 for producing a downward grinding force on the grinding wheel.

The roller 10 is rotatably mounted on a shaft and lever 15. A portion of the lever 15 is shown on an enlarged scale in FIGS. 3 and 4. This lever is rigidly connected or keyed to a shaft 18 which shaft is mounted for rotation about its own horizontal axis in bearings such as indicated at 19 in FIG. 4. A crank arm 20 is rigidly connected to each end of the shaft 18. In the preferred form, the crank arm 20 is connected to the shaft 18 by means of removable keys. The shaft 18 rotates about its own horizontal axis.

Figure 2:
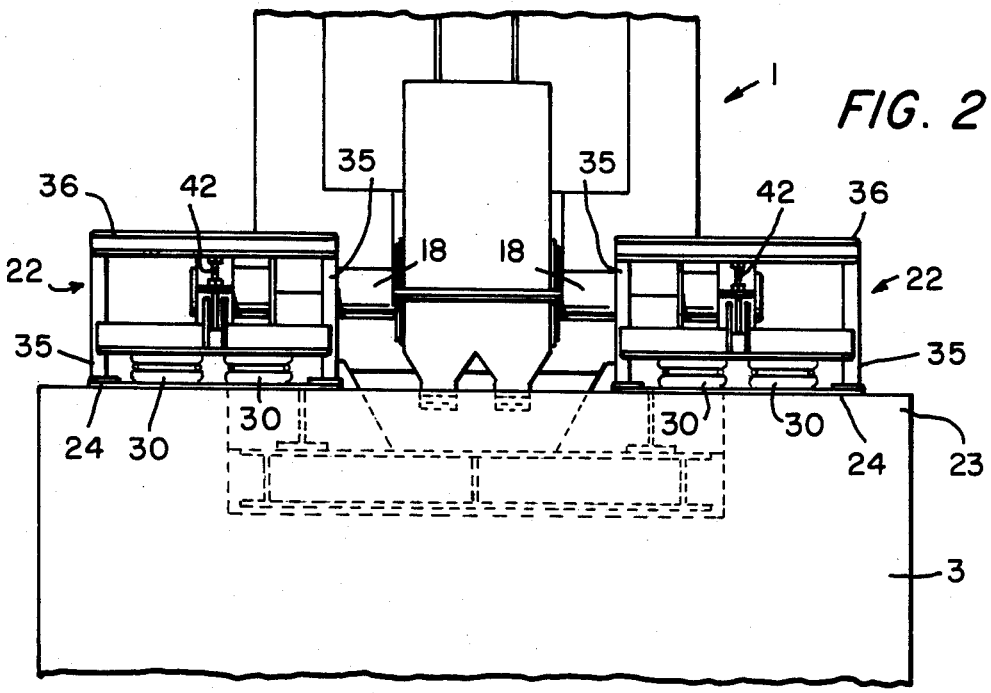
FIG. 2 is a side view of the mill shown in FIG. 1.
Figure 4:
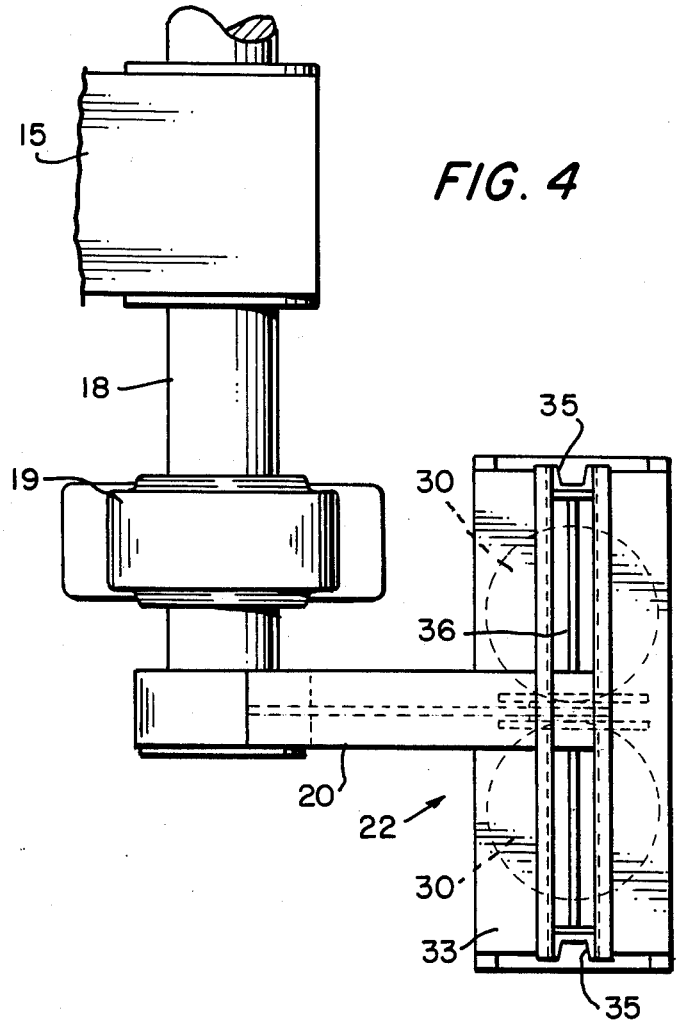
FIG. 4 is a top view of the portion of the mill shown in FIG. 3.
Figure 3:
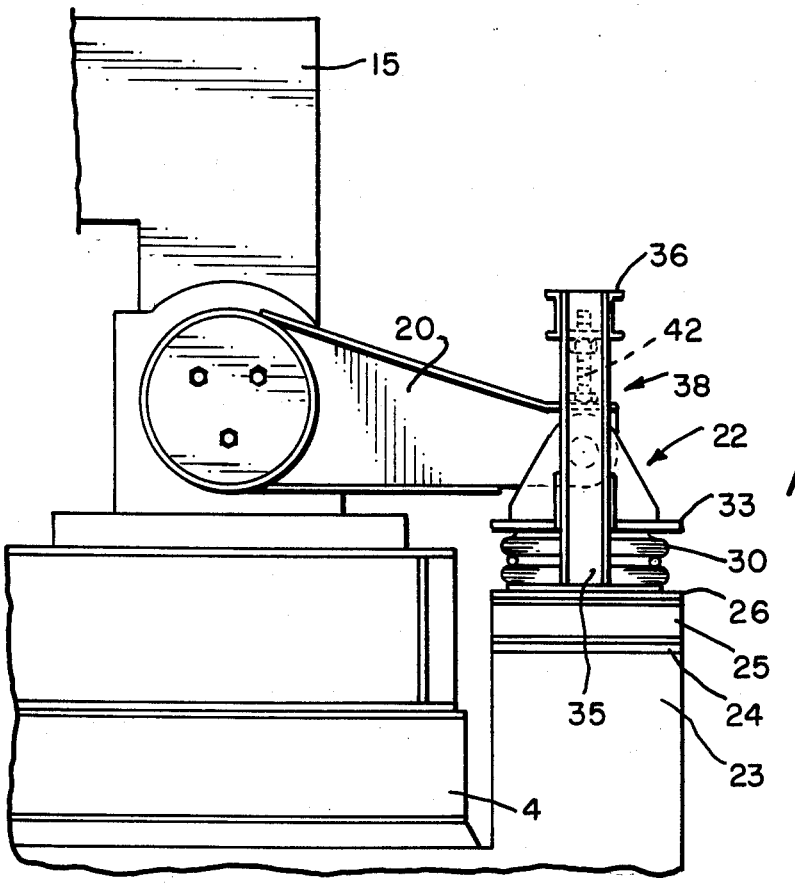
FIG. 3 is a detail on an enlarged scale of a portion of the mill utilizing the present invention.

As shown in FIGS. 1 and 3, the foundation 3 includes side sections 23 which extend above the base 4 of the mill 1. A pair of spaced apart pressurized flexible pneumatic cylinder means generally indicated at 22 are mounted on the sections 23. Each cylinder means 22 includes a base plate 24 mounted on the section 23 and a support beam 25 mounted on the base 24. A mounting plate 26 rest atop the support beam 25. On top of the mounting plate 26, there are a plurality of elastomeric bellows on flexible, pneumatic cylinders indicated at 30. In the drawing, two such bellows are illustrated for each means 22. An upper plate 33 is mounted atop the cylinders 30. The crank arm 20 is operatively connected at one end to the upper plate 33 and at its other end to shaft 18. The pneumatic cylinder means 22 also includes a pair of vertical guidebeams 35 on opposite ends of plate 26 as shown in FIGS. 2, 3 and 4.

A cross beam 36 extends between the side beams 35 at the top thereof (FIGS. 2 and 3). A travel stop generally indicated at 38 is positioned between the top of the crank arm 36 and the cross beam 36 and includes an adjustment means 42 in the form of a threaded member.

As illustrated in FIG. 2 a pneumatic actuator or flexible pneumatic cylinder means 22 assembly is operatively connected to each end of shaft 18. Thus, there are a total of four resilient pneumatic cylinders operatively connected to the shaft 18 and in the illustrated embodiment, four elastomeric bellows exerting downward grinding force on each roller 10.

In operation, the elastomeric bellows 30 are each filled with air under pressure at say 100 p.s.i. This pressure tends to expand the bellows 30 between the fixed foundation 23 and the upper plate 33. This expansion tends to exert an upward force on the plate 33 and the crank arm 20 thereby tending to rotate the shaft 18 in a counter-clockwise direction as viewed in FIG. 3. This torque on the shaft 18 tends to rotate the lever 15 in a counter-clockwise direction as viewed in FIG. 3 thereby exerting a downward grinding force on the roller assembly 10 which is operatively connected to the lever 15. As variations occur in the depth of material on the table 5, the roller assembly will tend to move up and down. These vibrations will be absorbed by the resilient cylinders 30 which will maintain operating pressure on the rollers 10.

With the present invention the grinding force on the grinding rollers 10 can be adjusted by increasing or decreasing the pressure in the cylinders 30. The guide beams 35 guide vertical movement of the bellows 30 and plate 33. The beam 36 and travel stop 38 and adjustment member 42 serve to prevent overextension or overcompression of the bellows 30 and prevent contact between the roller 10 and table wear element 6. Such contact could cause sparks, which in a coal mill could cause an explosion.

One of the particular advantages of the present invention is that in the event one of the bellows 30 should become punctured or otherwise lose pressure, all that will happen is that air will escape from that cylinder. While there may be a reduction in the grinding force exerted on the roller assembly 10 which may reduce mill capacity, it will be possible to continue to operate the roller mill until it is more convenient to shut down the mill. With the prior art of utilizing a hydraulic system, if there is a failure of one of the hydraulic cylinders, not only is the situation messy due to the spill of hydraulic fluid, but also it is likely that the grinding mill will have to be shut down due to the absence of any grinding force.

A further advantage of the present invention over prior practice is that it allows a greater degree of lateral movement of the grinding force exerting means. Thus, the invention is more than a mere substitution of a pneumatic means for an hydraulic means. If the various linkages should become somewhat misaligned, the bellows 30 will compensate for such misalignment. The device is of simple construction and costs are reduced through the elimination of hydraulic systems.

The air cylinders consist of pneumatic tire like configurations often used as spring assemblies on large vehicles such as trucks and buses. The cylinders may be of the type produced by various tire companys such as those marketed under the trademark "Airstroke" produced by Firestone Tire & Rubber Company.

From the foregoing it should be apparent that the objects of the present invention have been carried out. A novel pneumatic apparatus has been provided for exerting grinding force on the rollers of a roller mill. With the system of the present invention, in the event there is a partial loss of the apparatus for exerting the grinding force, the grinding mill can still be utilized. The mill itself is simlified by the elimination of a hydraulic system for exerting the grinding force and by the ability to utilize a concrete foundation rather than an oversized mill body to support the means for exerting the grinding force.

It is intended that the foregoing be a description of the preferred embodiment and the the invention be limited solely by that which is within the scope of the appended claims.

We claim:

1. In a grinding mill including a housing, a grinding table mounted within said housing for rotation about a substantially vertical axis, at least one grinding roller mounted for rotation about its own axis which is at an angle to the axis of the table and cooperable with said table for grinding material between said table and said roller, an improved means for supporting said grinding roller comprising; a plurality of horizontal spaced apart pressurized; flexible pneumatic cylinder means each operatively connected to the grinding roller for producing a downward grinding force on said grinding roller; a shaft, said grinding roller connected to said shaft and a crank arm connected to said shaft; said pneumatic cylinder means being positioned to exert an upward force on said crank arm whereby the upward force on the crank arm is transmitted to said grinding roller through said shaft to produce a downward force on said grinding roller to thereby operatively connect the pneumatic cylinder means to the grinding roller.

2. In a grinding mill according to claim 1, the improved means for supporting the grinding roller wherein said shaft is mounted substantially horizontal for rotation about its own axis.

3. In a grinding mill according to claim 2, the improved means for supporting the grinding roller wherein each of said pneumatic cylinder means includes a base plate, an elastomeric bellows, an upper plate mounted on said elastomeric bellows and there are a pair of horizontally spaced apart crank arms, each operatively connected to said upper plate and said shaft whereby an upward force exerted by pressure in the bellows is transferred to said crank arm through said upper plate, on said base plate.

4. In a grinding mill according to claim 3, said pneumatic cylinder means further comprising means for limiting vertical movement of the pneumatic cylinder means for preventing overextension and overcompression of the elastomeric bellows.

* * * * *